US007374308B2

(12) United States Patent
Sevack et al.

(10) Patent No.: US 7,374,308 B2
(45) Date of Patent: May 20, 2008

(54) LINEAR SPRING CLIP FOR SECURING LIGHTING REFLECTORS OR HOUSINGS INTO MOUNTING FRAMES

(76) Inventors: Lloyd Sevack, 9750 Boulevard, Maurice Duplessis, Montreal, Quebec, HIC 1G1 (CA); Mario Viscusi, 9750 Boulevard, Maurice Duplessis, Montreal, Quebec, HIC 1G1 (CA); Costa Dampollas, 9750 Boulevard, Maurice Duplessis, Montreal, Quebec, HIC 1G1 (CA)

( * ) Notice: Subject to any disclaimer, the term of this patent is extended or adjusted under 35 U.S.C. 154(b) by 263 days.

(21) Appl. No.: 11/256,854

(22) Filed: Oct. 24, 2005

(65) Prior Publication Data

US 2006/0087835 A1 Apr. 27, 2006

Related U.S. Application Data

(60) Provisional application No. 60/621,056, filed on Oct. 25, 2004.

(51) Int. Cl.
*F21S 8/02* (2006.01)

(52) U.S. Cl. ..... 362/147; 362/364; 362/365

(58) Field of Classification Search ..... 362/147, 362/148, 364, 365, 366, 368, 396; D26/72, D26/74, 83

See application file for complete search history.

(56) References Cited

U.S. PATENT DOCUMENTS

| | | | | |
|---|---|---|---|---|
| 4,039,822 | A | 8/1977 | Chan et al. | |
| 4,293,895 | A * | 10/1981 | Kristofek | 362/147 |
| 4,313,154 | A | 1/1982 | Capostagno et al. | |
| 4,729,073 | A * | 3/1988 | Klaus | 362/368 |
| 6,343,873 | B1 * | 2/2002 | Eberhard et al. | 362/364 |

* cited by examiner

*Primary Examiner*—Y. My Quach-Lee
(74) *Attorney, Agent, or Firm*—Alfred M. Walker

(57) ABSTRACT

A combination linear spring clip and capturing guide retains a reflector to a ceiling lighting fixture, which has a mounting frame secured in a ceiling, wherein the mounting frame includes an opening to accommodate the reflector. One or more capturing guides are mounted on an upper surface of the mounting frame surrounding the opening. Each capturing guide extends radially from a center of the opening. Respective springs are linearly slidable within the respective capturing guides, with a portion of each spring extending out of each capturing guide. Each linear spring clip engages an outer surface of the light fixture reflector to secure it in place, allowing the mounting of reflectors of varying size.

16 Claims, 9 Drawing Sheets

LINEAR SPRING CLIP FOR SECURING LIGHTING REFLECTORS OR HOUSINGS INTO MOUNTING FRAMES

RELATED APPLICATIONS

This application is based upon provisional patent application Ser. No. 60/621,056, filed Oct. 25, 2004, and claims priority and benefit under 35 United States Code, § 119(e).

FIELD OF THE INVENTION

This application relates to fasteners for recessed lighting fixtures.

BACKGROUND OF THE INVENTION

Recessed lighting fixtures are typically pushed into a steel mounting frame that is situated on the topside of the ceiling which is most often made of gypsum board or acoustical tile. The most common way of retaining the reflector so that its flange is in contact with the bottom (exposed) side of the ceiling panel is by use of what is known in the lighting industry as "roto-clips". An example of these is defined in U.S. Pat. No. 4,313,154 of Capostagno et al. where they are variously referred as "resilient reflector support members", "spring retainer members", and "mounting assemblies". An earlier U.S. Pat. No. 4,039,822 of Chan describes inclined gripping teeth which permit removal of the reflector by rotation of the reflector in the direction of the downward incline thereby causing the reflector to be cammed downward. This feature is also used in the roto-clips.

The existing retaining means for lighting reflectors have several shortcomings. Although the possibility of more than two arms is suggested in U.S. Pat. No. 4,313,154 of Capostagno et al., roto-clips typically have two arms, a short arm and a longer arm. Either can be swung into a position of contact with the reflector, but only two positions are offered. Oriented with the longer arm inward (toward reflector), they may apply excessive pressure against the reflector; with the shorter arm inward, insufficient pressure may be applied. Additionally, the point of contact of the end of the roto-clip is typically ½" above the topside of the mounting frame. While such elevation may grip reflectors having near vertical walls at their point of contact, reflectors that rapidly taper inward are susceptible to inferior grip or even loss of grip due to the low angle of presentation at the contact point. Roto-clips are typically riveted onto the mounting frame, a method permitting rotation but with substantial friction. However, the rivet mounting hole position dictates the pressure that either the long or short spring arm will exert against the reflector. Thus, unless there are multiple rivet holes allowing the roto-clip to be riveted nearer or farther away from the edge of the hole in the mounting frame, the design can only accommodate a slightly larger or smaller reflector than was originally intended. Note also that multiple rivet holes require experimentation and are prone to assembly errors. The time required to rivet the four roto-clips is another shortcoming; a supply of rivets and a riveting tool must also be at hand. Depending on the pressure exerted by the roto-clips, it can be difficult to remove the reflector. Because of the discrete projections of roto-clips, the reflector can only be mounted with a single level of eccentricity relative to the large hole in the mounting frame. By rotating two adjacent roto-clips with the longer leg extending inward, and the other two adjacent roto-clips with the shorter leg extending inward, a level of eccentricity is afforded, but possibly at the expense of appropriate retentive pressure on the reflector. Increased variability in offset positioning is desirable if there is a need to further offset the reflector to permit its flange to conceal larger blemishes in the ceiling panel adjacent to the hole that may have arisen while the hole was being cut.

OBJECTS OF THE INVENTION

It is therefore an object of the present invention to provide a lighting fixture reflector-retaining linear spring clip which conveniently slides linearly within guides in or affixed to the mounting frame.

It is also an object of the present invention to improve over the disadvantages of the prior art.

Other objects which become apparent from the following description of the present invention.

SUMMARY OF THE INVENTION

In keeping with these objects and others which may become apparent, the present invention relates to a new concept in retaining means that overcomes all of the above shortcomings.

The concept of this invention is for a spring that slides linearly within guides in or affixed to the mounting frame. With the spring containing a series of notches, holes, or other retention locking means, the inward projection of each spring toward the main hole in the mounting frame (where the reflector will be inserted) can be individually varied in order to accommodate any or all of the following:

a) varying degrees of pressure exerted upon the reflector;

b) varying degrees of resistance to the reflector slipping out;

c) varying degrees of ease of removal of the reflector;

d) a wider range of reflector sizes;

e) irregularly shaped reflectors (other than round, such as oval, elliptical, rectangular, etc.); and, d) secure the reflector eccentrically to the main hole in the mounting frame so that the reflector flange may conceal larger blemishes in the ceiling panel adjacent to the hole that may have arisen when its hole was cut.

e) low contact point with the reflector to reduce potential slippage on reflectors that rapidly taper inward.

Additional features of the present invention include:

a) there is no need to rivet or otherwise fasten the spring;

b) assembly (or even replacement) of the springs to the mounting frame can be accomplished without tools;

c) once installed, spring can be fully retracted so that the hole in the mounting frame may be used as a template for cutting the ceiling panel (as described by the prior art of Capostagno);

d) inclined gripping tooth so that rotation of the reflector in the same direction as the teeth inclination causes the reflector to be cammed downward for easy removal, as described in U.S. Pat. No. 4,039,822 (Chan). Note, that if an oval or elliptical reflector is installed, this method of removal will not be effective. Instead, the reflector will simply have to pulled down.

This spring would typically be made of a strong, resilient material, such as, for example, spring steel.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

The present invention has broad applications to different configurations for attaching lighting fixture reflectors to its respective frame. For illustrative purposes only, a preferred mode for carrying out the invention is described herein.

Figure 1:
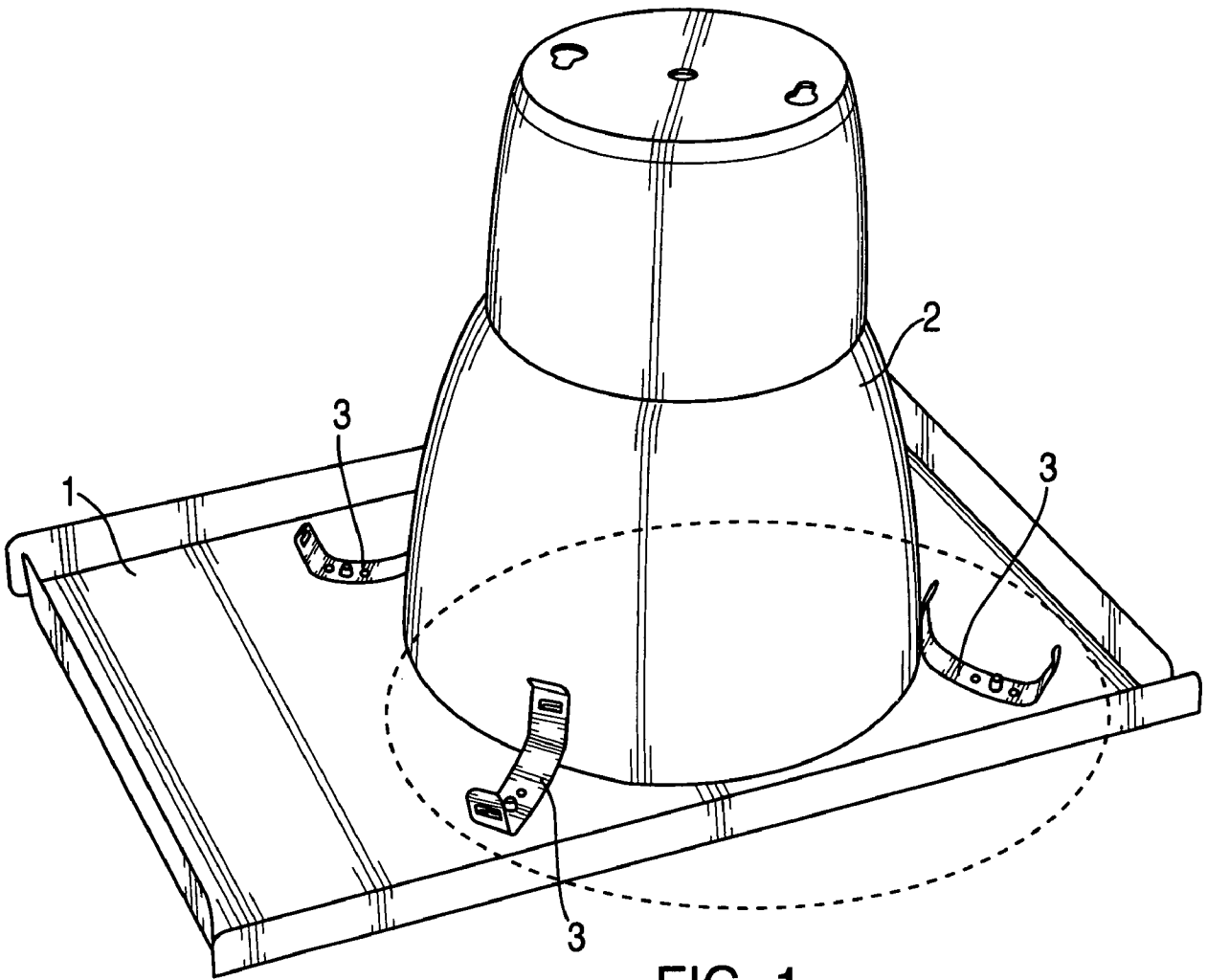
FIG. 1 (PRIOR ART)
FIG. 1 is a perspective view of a prior art mounting frame with roto-clips.
Figure 2:
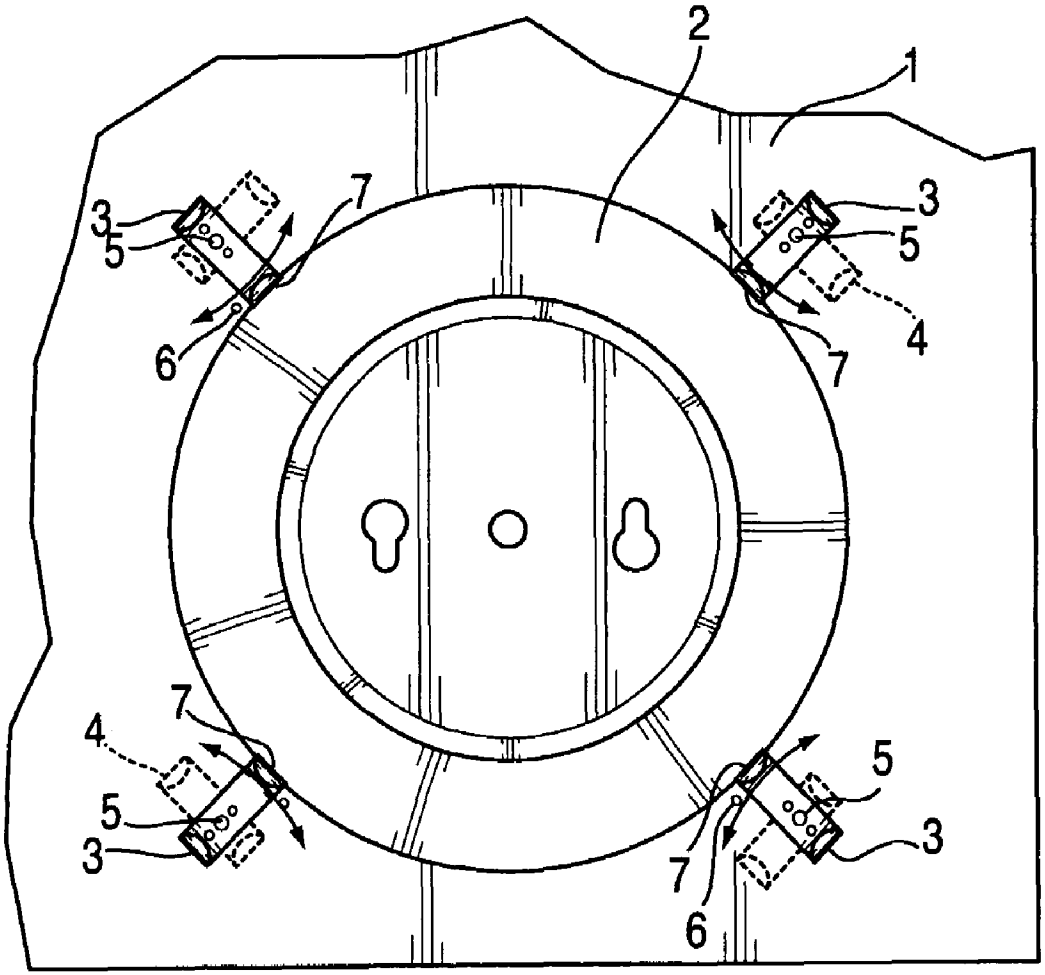
FIG. 2 (PRIOR ART)
FIG. 2 is a top plan view detail of the prior art mounting frame with roto-clips.

FIGS. 1 and 2 illustrate the prior art retaining method using roto clips 3 riveted 5 to mounting frame 1 to retain reflector 2. Reflector 2 is depicted as a closed ended reflector. Open ended reflectors (as in FIG. 3) can also be accommodated by the prior art or by the present invention. The detail of FIG. 2 shows the long arm 7 and the short arm 3 of the roto-clips as well as their rotating capability; an auxiliary rivet hole 6 is also shown in closer proximity to the opening to allow the roto-clip to be mounted closer to the opening.

Figure 3:
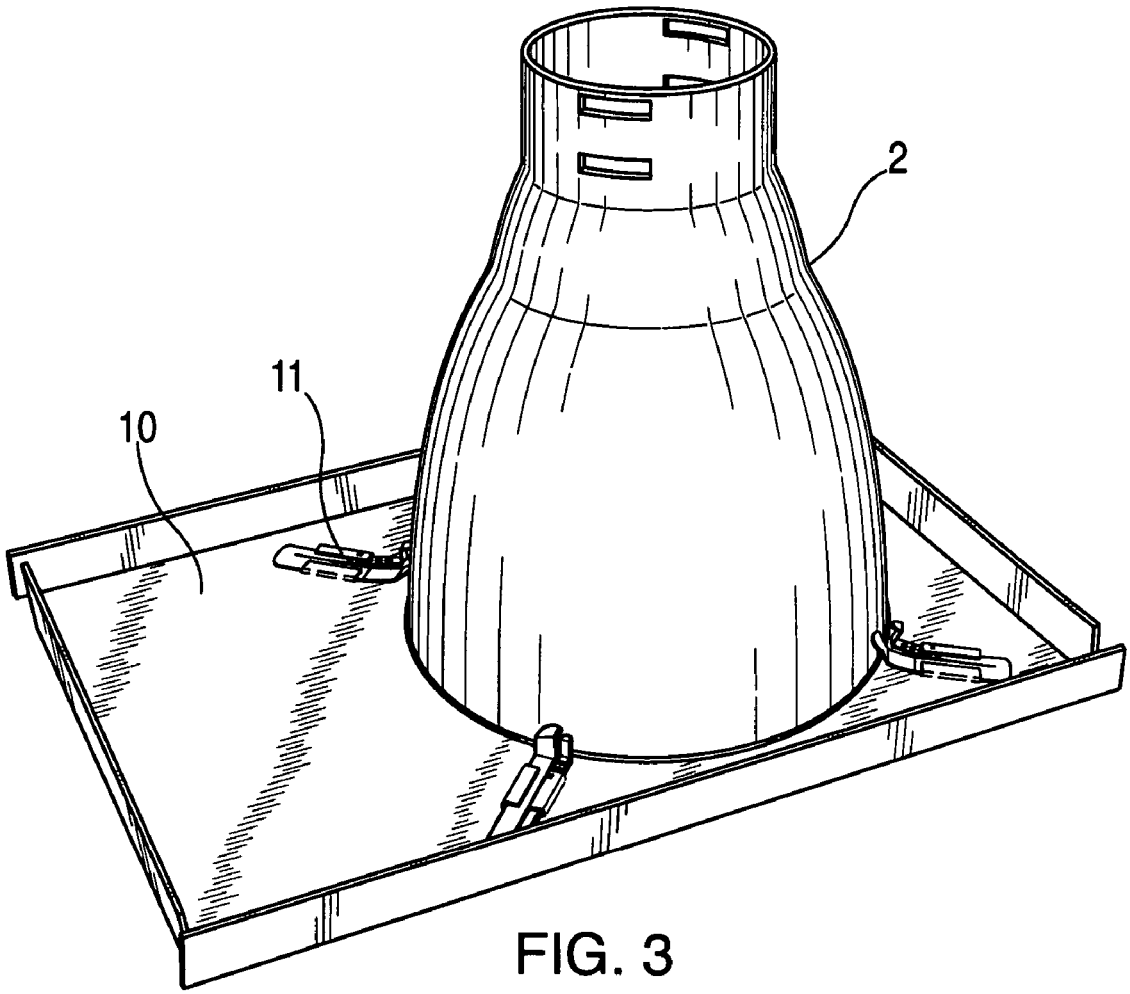
FIG. 3 is a perspective view of a mounting frame using linear spring clips of the preferred embodiment of this invention.

FIG. 3 shows frame 10 with linear spring clip system 11 of the preferred embodiment retaining reflector 2, here depicted as an open ended reflector.

Figure 4:
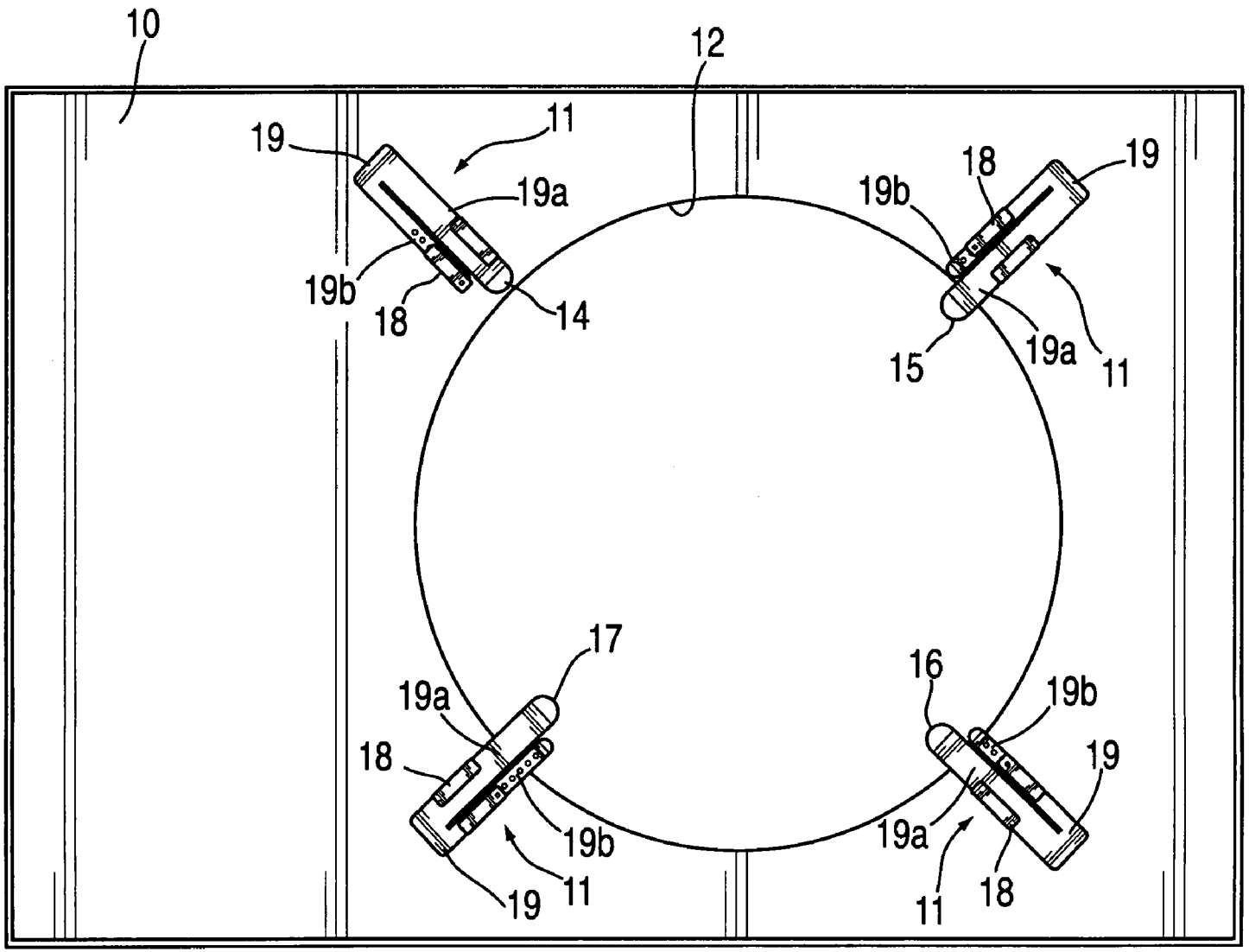
FIG. 4 is a top plan view showing the mounting frame with linear spring clips in various positions of advancement.

FIG. 4 shows four spring clip systems 11 in a progression of spring clip 19 with long extension portion 19*a* and short extension portion 19*b*. Spring clips 19 are shown in a series of positions, from a fully retracted position 14 through positions 15, 16, and 17, where in position 17 spring clip 19 is shown fully advanced. Spring clips 19 are retained to frame 10 within capturing guides 18 die formed from material of frame 10 around the periphery of reflector mounting hole 12.

In this and all embodiments of this invention, the capturing guides are preferably factory die formed from frame material, as shown in FIGS. 3 through 6, or they can be formed from auxiliary plates which are spot welded to frame 10 at the factory, as shown in FIGS. 7 through 14.

Figure 5:
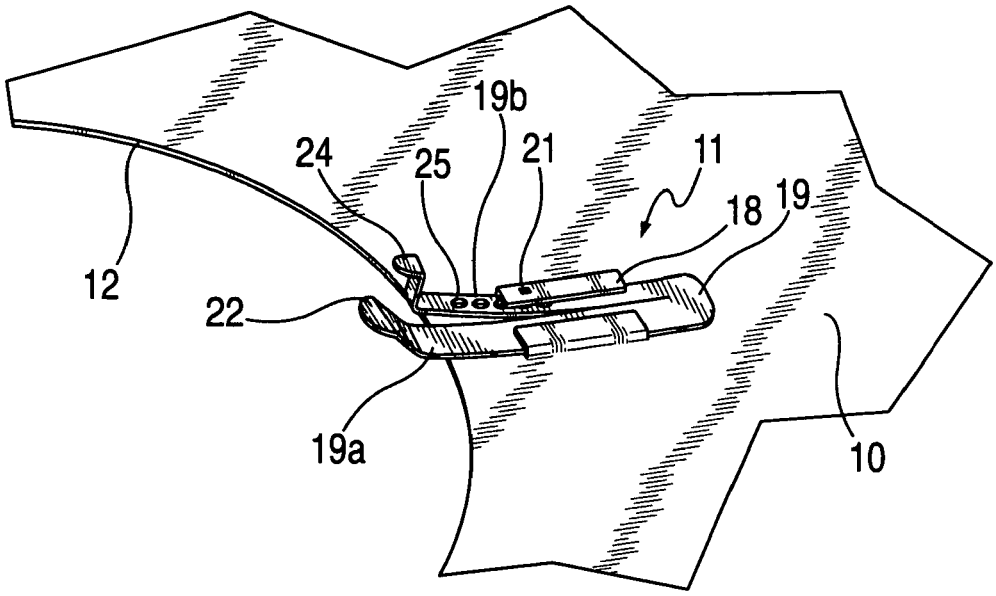
FIG. 5 is a perspective view of a preferred embodiment linear spring clip within capturing guides.
Figure 6:
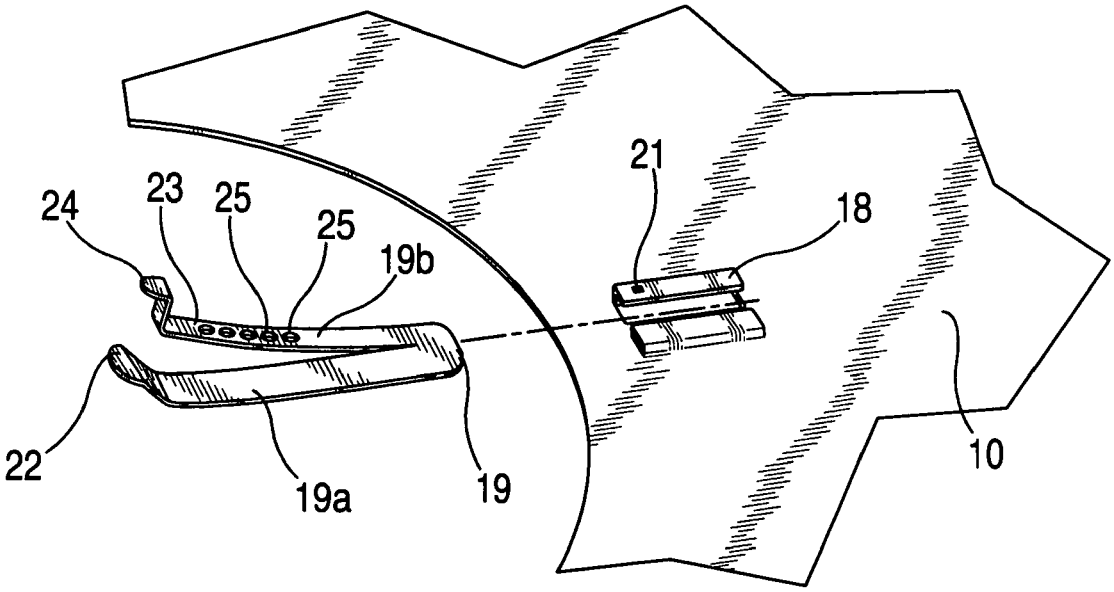
FIG. 6 is a perspective view of the preferred embodiment linear spring clip spaced apart from capturing guides.

FIG. 5 is a close-up of preferred embodiment linear spring clip 11 within capturing guide 18, while FIG. 6 shows the two parts spaced apart. The flat, linear portion 19*a* of spring clip element itself 19 is die formed of flat spring steel stock with a wider retention portion with an edge of tilted distal portion 22 of clip 19 for engaging reflector 2 (as shown in FIG. 3). Attached raised section 23 with tip 24 and adjustment holes 25 which engage a retention locking means, such as downward projection 21 in one side of guide 18 permit convenient adjustment by depressing tip 24 and exerting either an inward or outward force within guide 18.

Figure 7:
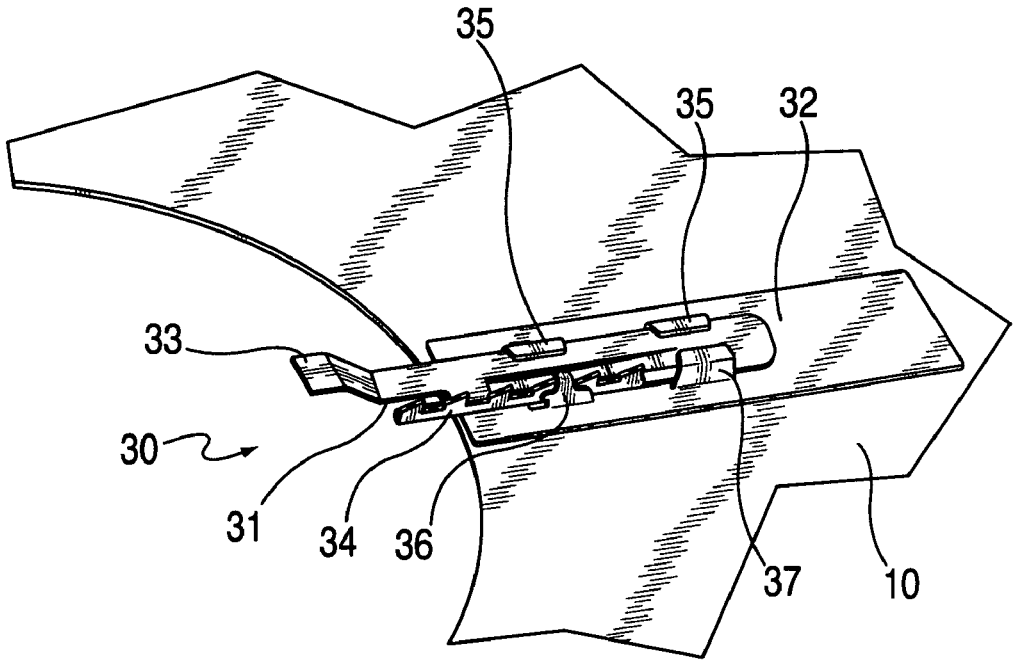
FIG. 7 is a perspective view of the first alternate embodiment of a linear spring clip within capturing guides.
Figure 8:
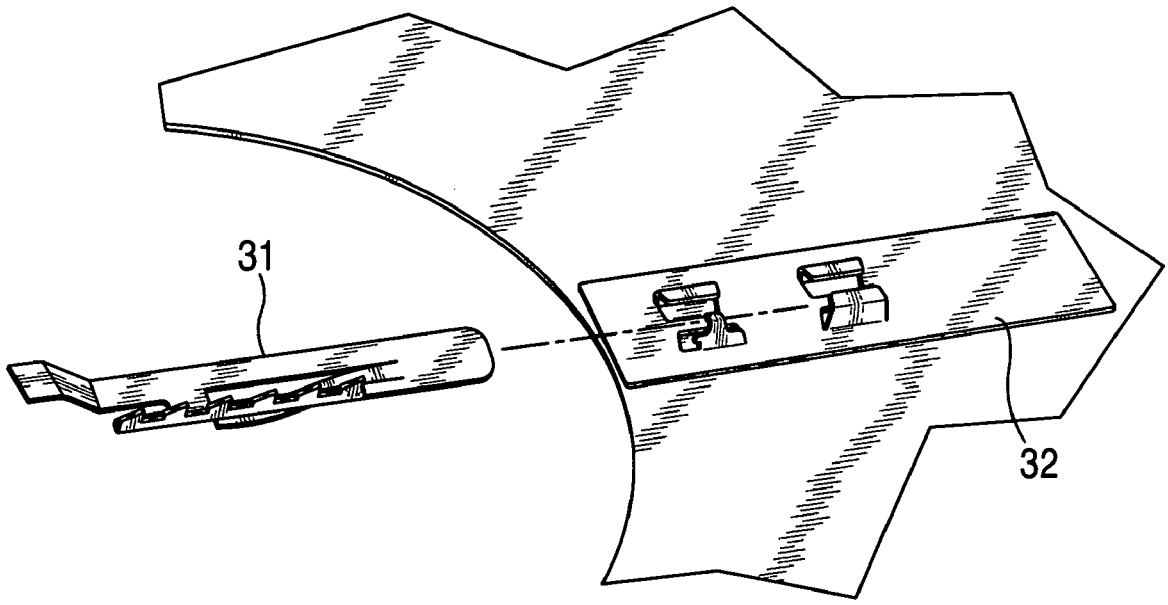
FIG. 8 is a perspective view of the linear spring clip of FIG. 7 spaced apart from capturing guides.

FIGS. 7 and 8 are close-ups of the first alternate embodiment 30 spring clip system of this invention. Although spring clip guide 32 can be die formed from frame 10, in these illustrations guide 32 is formed on a separate plate and is spot welded or otherwise affixed to frame 10. One side of guide 32 includes two capturing flanges 35 while the opposite side has capturing flange 37 at the back end and a narrow guide 36 toward the front which engages and retains the vertical notches in the side leaf spring portion 34 of spring that has vertical notches of spring clip element 31. Tilted distal edge 33 on the wider portion of spring clip element 31 engages the reflector. This embodiment is operated by squeezing the front ends of the two parts of clip element 31 laterally thereby disengaging the vertical notches in portion 34 from narrow guide 36 to permit movement within guides 35 and 37 or complete withdrawal as in FIG. 8.

Figure 9:
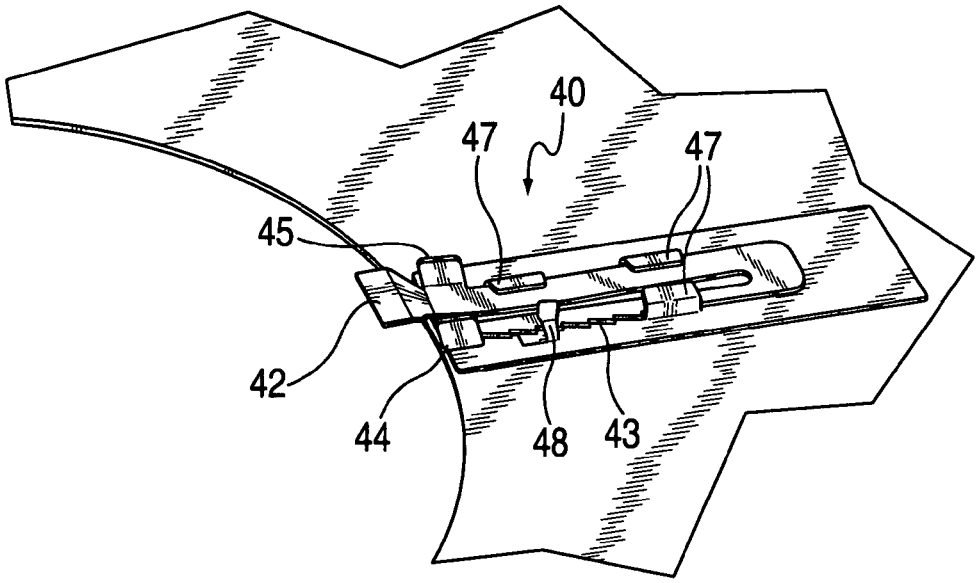
FIG. 9 is a perspective view of second alternate embodiment of a linear spring clip of this invention within capturing guides.
Figure 10:
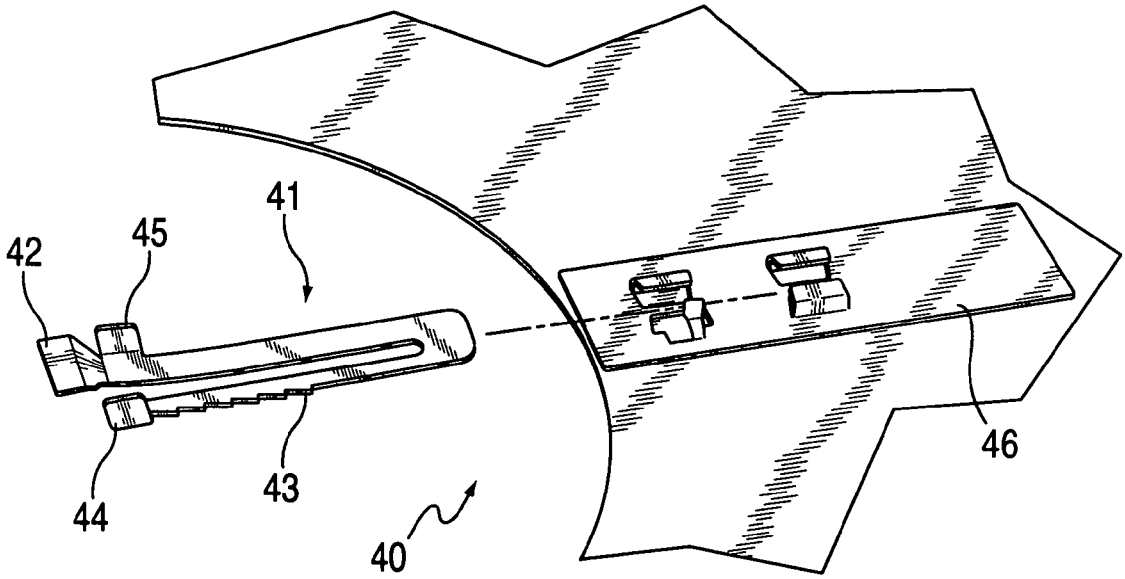
FIG. 10 is a perspective view of the linear spring clip of FIG. 9 spaced apart from capturing guides.

FIGS. 9 and 10 show the second alternate embodiment 40 spring clip system of this invention. Guide 46 includes three guide flanges 47 as well as a narrow retention and engaging guide 48 at the front of one side. Spring clip element 41 has a wider raised part with angled contact edge 42 at its distal end and a side bent up tab 45. A second parallel flat base finger 43 has side facing angled notches which engage narrow guide 48 with bent up tab 44 at its distal end. To disengage for movement (or total withdrawal from guides as in FIG. 9), both bent up tabs 44 and 45 are squeezed laterally toward each other.

Figure 11:
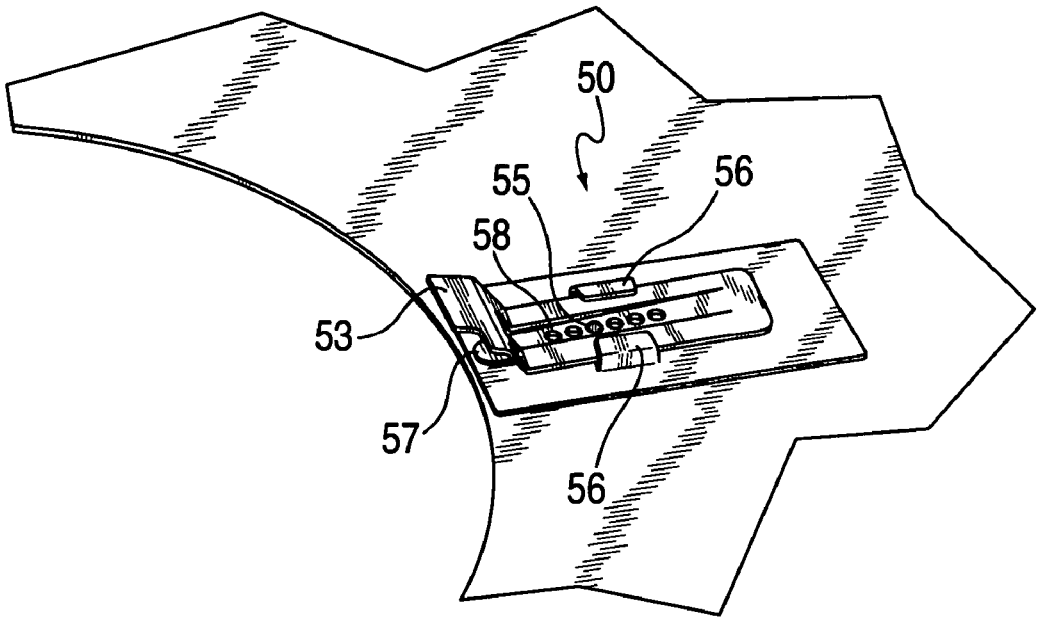
FIG. 11 is a perspective view of the third alternate embodiment of a linear spring clip of this invention within capturing guides.
Figure 12:
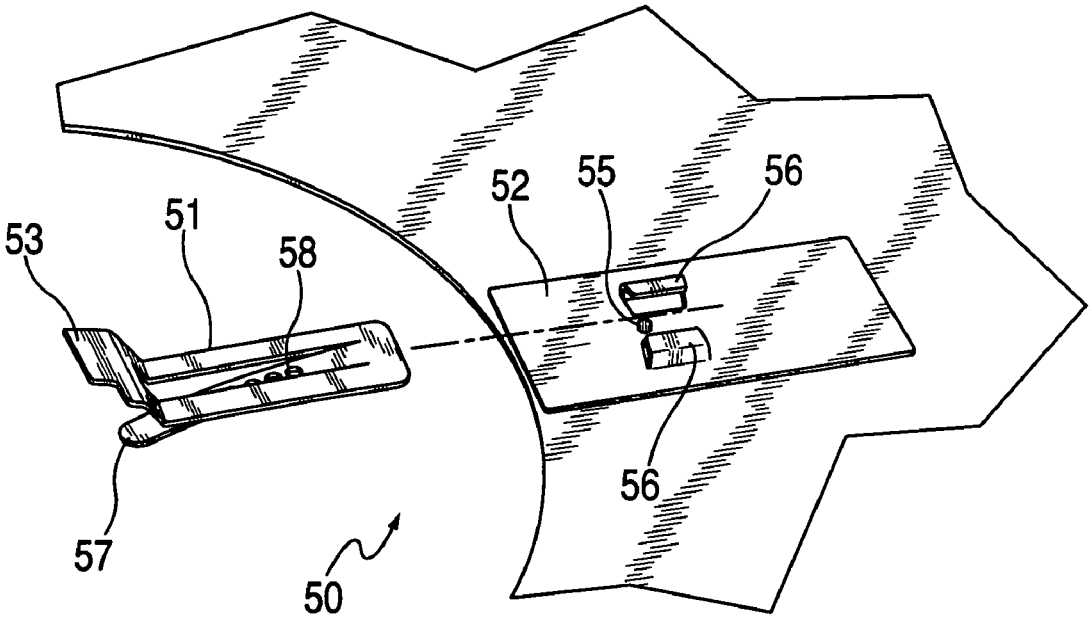
FIG. 12 is a perspective view of the linear spring clip of FIG. 11 spaced apart from capturing guides.

FIGS. 11 and 12 show the third alternate embodiment 50 spring clip system of this invention. Here, guide portion 52 simply consists of a single pair of bent guide flanges 56 with an upward facing protrusion retaining member 55 between. Spring clip element 51 has a central finger angled down with a linear array of positioning holes 58. Frame members at each side come together at a raised bent portion at the front with angled contact edge 53 at its distal end. Holes 58 engage protrusion retention member 55 to lock spring clip element 51 in place. To disengage permitting adjustment or withdrawal, distal tip 57 of central finger is lifted toward edge 53.

Figure 13:
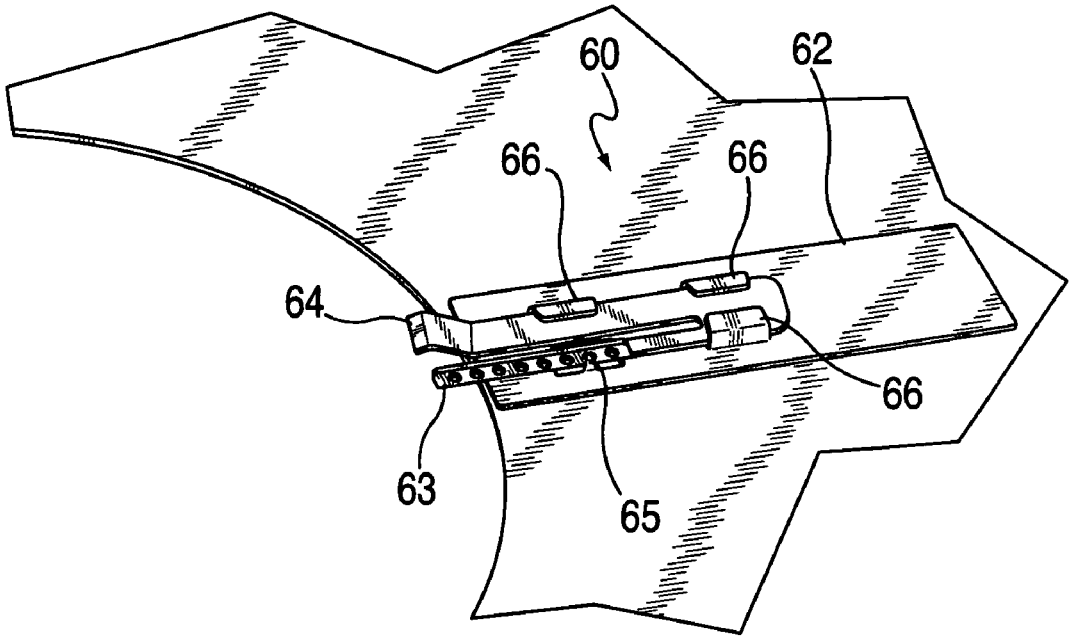
FIG. 13 is a perspective view of the fourth alternate embodiment of linear spring clip within capturing guides; and, FIG. 14 is a perspective view of the linear spring clip of FIG. 13 spaced apart from capturing guides.
Figure 14:
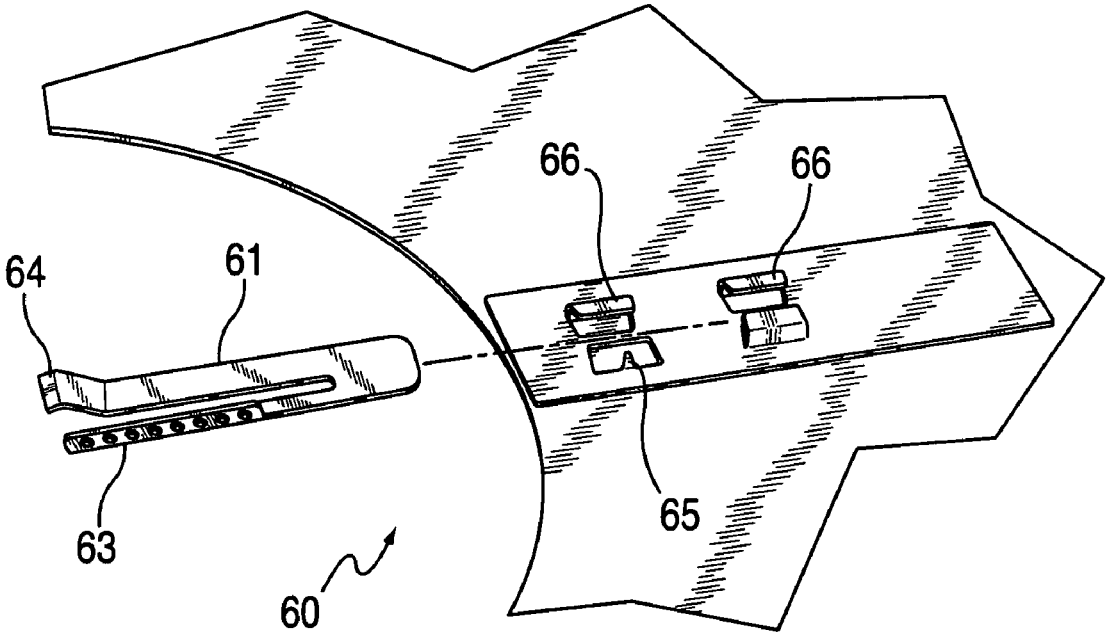

FIGS. 13 and 14 show the fourth alternate embodiment 60 spring clip system of this invention. Guide portion 62 consists of three side guide flanges 66 and a narrow bent up and over engaging retention member 65. Spring clip element 61 is bifurcated into a wide flat finger terminating in a bent up front with angled contact edge 64 at its distal end with a narrower finger 63 bent up 90 degrees along its long dimension with a linear array of adjustment holes. For disengagement of member 65 from one of the array holes, element 63 is squeezed toward contact edge 64 thereby permitting adjustment into and out of guides flanges 66.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A combination linear spring clip and capturing guide for retaining a reflector to a ceiling lighting fixture having a mounting frame secured in a ceiling, wherein said mounting frame includes an opening to accommodate said reflector, said combination comprising:

at least one capturing guide located at a surface of a plate surrounding said opening;

said at least one capturing guide extending radially from a center of said opening, said at least one capturing guide having an entry adjacent said opening;

at least one spring linearly slidable within said at least one capturing guide, with a portion of said spring extending out of said capturing guide entry into said opening; and means on said at least one capturing guide to secure said at least one spring in any one of a number of positions along said guide to engage an outer surface of said reflector for securing said reflector in place, allowing the mounting of reflectors of varying size.

2. The combination linear spring clip and capturing guide as in claim 1 wherein said at least one spring is a plurality of spring clips and said at least one capturing guide is a plurality of capturing guides.

3. The combination linear spring clip and capturing guide as in claim 1 wherein said at least one spring is a plurality of springs equally spaced radially from the center of said opening.

4. The combination linear spring clip and capturing guide of claim 1 in which said at least one spring is a leaf spring and having at least one hole, and said secure means comprises a projection located at said at least one capturing guide to capture said at least one hole.

5. The combination linear spring clip and capturing guide of claim 4 in which said at least one leaf spring comprises a pair of first and second spring members joined at one end and sprung apart at distal ends for insertion of the joined end into said guide, the second spring member being longer than said first spring member and said longer spring member having a distal end for engaging said outer surface of said reflector and the first spring member having said at least one hole, said first and second spring members being squeezed together to disengage from said projection allowing said leaf spring to be moved along said capturing guide.

6. The combination linear spring clip and capturing guide of claim 5 in which said first and second spring members extend linearly and obliquely from each other.

7. The combination linear spring clip and capturing guide of claim 4 in which said at least one hole is a plurality of holes.

8. A ceiling lighting fixture for supporting a reflector comprising:

a mounting frame secured in a ceiling, said mounting frame having an opening to accommodate said reflector;

at least one capturing guide located at a surface of a plate surrounding said opening;

said at least one capturing guide extending radially from a center of said opening, said at least one capturing guide having an entry adjacent said opening;

at least one spring linearly slidable within said at least one capturing guide with a portion of said spring extending out of said capturing guide entry into said opening; and means on said at least one capturing guide to secure said at least one spring in any one of a number of positions along said guide to engage an outer surface of said reflector for securing said reflector in place allowing the mounting of reflectors of varying size.

9. The ceiling lighting fixture for supporting a reflector as in claim 8 wherein said at least one spring is a plurality of spring clips and said at least one capturing guide is a plurality of capturing guides.

10. The ceiling lighting fixture for supporting a reflector as in claim 8 wherein said at least one spring is a plurality of springs equally spaced radially from the center of said opening.

11. The ceiling lighting fixture for supporting a reflector of claim 8 in which said at least one spring is a leaf spring and having at least one hole, and said secure means comprises at least one projection located at said at least one capturing guide to capture said hole.

12. The ceiling lighting fixture for supporting a reflector of claim 11 in which said at least one leaf spring comprises a pair of first and second spring members joined at one end and sprung apart at distal ends for insertion of the joined end into said at least one capturing guide, the second spring member being longer than said first spring member and having a distal end for engaging said outer surface of said reflector and the first spring member having said at least one hole, said first and second spring members being squeezed together to disengage from said projection allowing said leaf spring to be moved along said at least one capturing guide.

13. The ceiling lighting fixture for supporting a reflector of claim 12 in which said first and second spring members extend linearly and obliquely from each other.

14. The combination linear spring clip and capturing guide of claim 11 in which said at least one hole is a plurality of horizontal holes with said projection for engaging one of said holes.

15. A combination linear spring clip and capturing guide for retaining a reflector to a ceiling lighting fixture having a mounting frame secured in a ceiling, wherein said mounting frame includes an opening to accommodate said reflector, said combination comprising:

a plurality of radially extending capturing guides located at a surface of a plate surrounding said opening;

each said capturing guide extending radially from a center of said opening, each said capturing guide having an entry adjacent said opening;

a plurality of linearly extending springs;

each said spring linearly slidable within a respective capturing guide of said plurality of capturing guides, with a portion of each said spring extending out of each said capturing guide entry into said opening;

means to secure each said spring in position to engage an outer surface of said reflector for securing said reflector in place, allowing the mounting of reflectors of varying size;

each said spring being a leaf spring and each said secure means comprises at least one hole in each said leaf spring and a projection located at each said capturing guide to capture said hole.

each said leaf spring comprising a pair of first and second spring members joined at one end and sprung apart at distal ends for insertion of the joined end into a respective guide, the second spring member being longer than said first spring member and having a distal end for engaging said outer surface of said reflector and the first spring member having said at least one hole, said first and second spring members being squeezed together to disengage from said projection allowing said respective leaf spring to be moved along said respective capturing guide; and each said upper and lower spring members extending linearly and obliquely from each other.

16. A combination linear spring clip and capturing guide for retaining a reflector to a ceiling lighting fixture having a mounting frame secured in a ceiling, wherein said mounting frame includes an opening to accommodate said reflector, said combination comprising:

at least one capturing guide located at a surface of a plate surrounding said opening;

said at least one capturing guide extending radially from a center of said opening, said at least one capturing guide having an entry adjacent said opening;

at least one spring linearly slidable within said at least one capturing guide, with a portion of said spring extending out of said capturing guide entry into said opening;

means on said at least one capturing guide to secure said at least one spring in any one of a number of positions along said guide to engage an outer surface of said reflector for securing said reflector in place, allowing the mounting of reflectors of varying size;

said at least one spring being a leaf spring; said leaf spring having a linearly extending member having a horizontal portion and an upwardly extending oblique portion;

said leaf spring further having a further linearly extending portion, said further linearly extending portion engageable with said securing means comprising a retention member located at said at least one capturing guide.

* * * * *